US008587509B2

(12) United States Patent
Takahashi et al.

(10) Patent No.: US 8,587,509 B2
(45) Date of Patent: Nov. 19, 2013

(54) DISPLAY DEVICE AND DRIVE METHOD FOR DRIVING THE SAME

(75) Inventors: Yoshihisa Takahashi, Osaka (JP); Yasuaki Iwase, Osaka (JP); Mayuko Sakamoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 273 days.

(21) Appl. No.: 12/998,517

(22) PCT Filed: Jun. 12, 2009

(86) PCT No.: PCT/JP2009/060758

§ 371 (c)(1), (2), (4) Date: Apr. 28, 2011

(87) PCT Pub. No.: WO2010/061656

PCT Pub. Date: Jun. 3, 2010

(65) Prior Publication Data

US 2011/0205194 A1 Aug. 25, 2011

(30) Foreign Application Priority Data

Nov. 28, 2008 (JP) ..... 2008-303709

(51) Int. Cl.
*G09G 3/36* (2006.01)

(52) U.S. Cl.
USPC ..... 345/100

(58) Field of Classification Search
USPC ..... 345/98–100
See application file for complete search history.

(56) References Cited

U.S. PATENT DOCUMENTS

| | | | | |
|---|---|---|---|---|
| 4,922,240 | A | 5/1990 | Duwaer | |
| 7,605,810 | B2 * | 10/2009 | Shin | 345/214 |
| 7,652,651 | B2 * | 1/2010 | Yoon et al. | 345/98 |
| 2004/0056833 | A1 | 3/2004 | Kitagawa et al. | |
| 2008/0225024 | A1 | 9/2008 | Ito | |

FOREIGN PATENT DOCUMENTS

| | | | |
|---|---|---|---|
| JP | 01202793 | A | 8/1989 |
| JP | 0521036 | A | 1/1993 |
| JP | 200029441 | A | 10/2001 |
| JP | 2002244619 | A | 8/2002 |
| JP | 200305152 | A | 1/2003 |
| JP | 2004117742 | A | 4/2004 |
| JP | 200865352 | A1 | 3/2008 |
| JP | 2008225036 | A | 9/2008 |
| JP | 2008233454 | A | 10/2008 |

* cited by examiner

*Primary Examiner* — Bipin Shalwala
*Assistant Examiner* — Steven Holton
(74) *Attorney, Agent, or Firm* — Harness, Dickey & Pierce, P.L.C.

(57) ABSTRACT

A display device of at least one embodiment of the present invention has a connection changeover circuit, including switch elements for time-division driving, formed on a liquid crystal panel, and the switch elements are paired so that two switch elements in each pair are connected in parallel to one video signal line. The paired switch elements are turned on at the same time, and immediately before one of the switch elements is turned off upon completion of a charging period for its corresponding video signal line, only the other switch element is turned off. As a result, while maintaining drive performance, it is possible to solve the impact of fieldthrough phenomenon caused by one of the switch elements, which are transistors, and also reduce parasitic capacitance formed in the other switch element, thereby suppress the impact of fieldthrough phenomenon caused by that switch element.

18 Claims, 7 Drawing Sheets

DISPLAY DEVICE AND DRIVE METHOD FOR DRIVING THE SAME

TECHNICAL FIELD

The present invention relates to active-matrix display devices, more specifically to a display device which employs, for example, a dot-sequence driving system, a phase expansion driving system or a video signal line time-division driving system, and a drive method therefor, in which video signals are sequentially outputted from a drive circuit through switch elements to a number of video signal lines for transmitting the video signals to a plurality of pixel formation portions for forming an image to be displayed.

BACKGROUND ART

In general, an active-matrix liquid crystal display device has a liquid crystal panel, including two substrates with a liquid crystal layer provided therebetween, as a display portion, in which a plurality of data lines as video signal lines and a plurality of gate lines as scanning signal lines are arranged in a matrix on one of the two substrates and a plurality of pixel formation portions are provided and arranged in a matrix at their corresponding intersections of the data lines and the gate lines. The pixel formation portions are components for displaying an image on the liquid crystal panel and each of them includes a TFT (thin-film transistor), which is a switching element having a gate terminal connected to the gate line and a source terminal connected to the data line, and a pixel electrode connected to a drain terminal of the TFT.

Such an active-matrix liquid crystal display device includes a data driver for driving the data lines of the liquid crystal panel, a gate driver for driving the gate lines, a common electrode drive circuit for driving the common electrode, and a display control circuit for controlling the data driver, the gate driver and the common electrode drive circuit.

While in recent years, display devices have advanced to display higher-definition images, the number of signal lines (electrodes) per unit length in display devices, such as active-matrix liquid crystal display devices, which require signal lines (column or row electrodes) in a number corresponding to the resolution of images to be displayed, is increasing significantly as the definition of display image resolution becomes higher. Consequently, when mounting a drive circuit for applying signals to the signal lines, the pitch (hereinafter, the "connection pitch") between connections of output terminals of the drive circuit to the signal lines on a display panel is extremely fine. In the case of color display devices, such as color liquid crystal display devices, which use three adjacent pixels, R (red), G (green) and B (blue), as a unit of display, such tendency toward a finer connection pitch to achieve higher-definition display images is pronounced especially at the connections of video signal lines to their drive circuit (data driver).

To solve such a problem, until now, there have been proposed some liquid crystal display devices that are configured such that video signal lines are divided into groups of two or more (e.g., three video signal lines corresponding to three adjacent pixels R, G and B), the video signal lines in each group are assigned one output terminal of a video signal line drive circuit, video signals are collectively outputted from all output terminals within one horizontal scanning period during image display (a so-called line-sequential driving system), and the video signals are applied to the video signal lines in each group in a time-division manner.

For example, Japanese Laid-Open Patent Publication No. 2000-29441 discloses a liquid crystal display device in which three analog switches are controlled to sequentially connect three video signal lines, which correspond to three adjacent pixels, R, G and B, to one output terminal of a source driver. Also, Japanese Laid-Open Patent Publication No. 2003-5152 discloses a liquid crystal display device in which two video signal lines are switched so as to be alternatingly connected to one output terminal of a source driver. Furthermore, Japanese Laid-Open Patent Publication No. 2002-244619 discloses an LED display device in which three FETs are controlled to sequentially connect three LEDs, which emit light of their respective colors, R, G and B, to a constant current driver.

In the case of the aforementioned liquid crystal display device with the video signal line time-division driving system, the time of charging each video signal line decreases in accordance with the number of video signal lines in each group, i.e., the number of time divisions by a changeover switch, and when the number of time divisions is m, the charging time for each video signal line is 1/m of that for typical liquid crystal display devices that are not on the video signal line time-division driving system. However, by forming changeover switches with the number of time divisions being m on a liquid crystal panel substrate, it becomes possible to increase m-fold the connection pitch between connections of the output terminals of the video signal line drive circuit to the video signal lines when compared to typical liquid crystal display devices. Also, with such a configuration, it is possible to reduce the number of integrated circuit chips (IC chips) when a video signal line drive circuit consisting of such chips is used for driving a liquid crystal panel. The advantage of such a video signal line time-division driving system is widely known, and the grouping of the video signal lines therefor is often performed such that each group is made up of three video signal lines for transmitting video signals to three adjacent pixels, R (red), G (green) and B (blue).

Also, some display devices, such as the aforementioned active-matrix liquid crystal display devices, which require data or gate lines (column or row electrodes) in a number corresponding to the resolution of images to be displayed, might employ a so-called dot-sequence driving system for sequentially driving the video signal lines, instead of employing the aforementioned line-sequential driving system. The dot-sequence driving system advantageously makes it possible to achieve a simplified device configuration. In the case of the dot-sequence driving system, however, higher-definition display images might result in reduced time of sampling video signals to be provided to the data lines and also reduced time of providing the video signals to the data lines (reduced charging time).

Therefore, in some cases, a so-called phase expansion driving system (phase expansion processing system) is employed to extend the sampling time and the charging time, which, however, results in a more complicated device configuration when compared to the dot-sequence driving system. The phase expansion processing refers to processing for properly displaying an image represented by a high-frequency image signal, in which the duration of an image-representing signal per dot or pixel (hereinafter, referred to as the "per-dot signal duration" or the "per-pixel signal duration") is extended and the frequency of an image signal to be provided to the liquid crystal panel is reduced. Note that when the phase expansion processing is performed such that the per-dot signal duration is n times the dot clock (pulse repetition) period, the processing is referred to as "n-phase expansion".

FIG. 8 is a partial configuration diagram of a data driver which is a circuit for driving data lines in a liquid crystal display device in which two-phase expansion is performed. The data driver is supplied with analog video signals AV, which are generated by two-phase expansion being performed for each of the R (red), G (green) and B (blue) colors in a predetermined phase expansion circuit, via six signal lines. A shift register 91 sequentially outputs sampling pulses from flip-flop circuits FF1, FF2, . . . , in an input to output terminal direction. As a result, analog switches in the figure are turned on, so that the analog video signals AV being fed from the phase expansion circuit are supplied to their corresponding video signal lines of a liquid crystal panel, two color pixels at a time, thereby displaying an image (it is assumed here that each color pixel is displayed by three adjacent pixel formation portions for displaying R, G and B colors, respectively).

For example, Japanese Laid-Open Patent Publication No. 5-21036 discloses a configuration of a liquid crystal display device in which four-phase expansion is performed. Also, Japanese Laid-Open Patent Publication No. 1-202793 discloses a configuration of a liquid crystal display device in which signal lines are halved into those connected to pixels in even columns and those connected to pixels in odd columns, and the columns are driven from opposite sides of a panel.

CITATION LIST

Patent Document

[Patent Document 1] Japanese Laid-Open Patent Publication No. 2000-29441

[Patent Document 2] Japanese Laid-Open Patent Publication No. 2003-5152

[Patent Document 3] Japanese Laid-Open Patent Publication No. 2002-244619

[Patent Document 4] Japanese Laid-Open Patent Publication No. 5-21036

[Patent Document 5] Japanese Laid-Open Patent Publication No. 1-202793

DISCLOSURE OF THE INVENTION

Problems to be Solved by the Invention

The changeover switch (analog switch) connected to the video signal line as included in the aforementioned display devices on the video signal line time-division driving system or the phase expansion driving system is typically a field-effect transistor having parasitic capacitance Cgd between its gate and drain. Accordingly, when the transistor is switched from on to off state, voltage $V_d$ at the drain terminal fluctuates in accordance with the parasitic capacitance. This phenomenon is called fieldthrough. In the aforementioned display devices, this phenomenon appears as a potential drop on the video signal line connected to the drain terminal when the transistor is turned on because charges stored in capacitance connected to the video signal line and the parasitic capacitance Cgd between the gate and the drain of the transistor are redistributed until the transistor is turned off due to a potential drop at the gate terminal. Therefore, by reducing the parasitic capacitance Cgd, the fieldthrough phenomenon can be suppressed.

However, to reduce the parasitic capacitance Cgd, it is necessary to reduce the channel width of the transistor, which results in reduced driving performance of the transistor, making it impossible for the video signal line to reach a desired potential level within a predetermined period of time. In particular, TFTs using microcrystalline silicon (μc-Si), amorphous silicon (a-Si), or an oxide semiconductor, such as zinc oxide (ZnO), have relatively low mobility, and therefore, to provide sufficient driving performance for image display, the channel width needs to be relatively large, resulting in increased parasitic capacitance Cgd.

Also, the changeover switch or the analog switch connected to the video signal line as included in the aforementioned display devices on the aforementioned video signal line time-division driving system or the phase expansion driving system is turned on/off significantly more times than the TFT included in the pixel formation portion is, and therefore its usable period (device life) is shortened. The shortened device life is often seen in the form of a threshold voltage shift (beyond a normal range) due to a voltage of the same sign being applied to the gate terminal of the TFT. Note that TFTs using amorphous silicon are especially susceptible to such a shift phenomenon.

Therefore, the present invention aims to provide a display device employing the video signal line time-division driving system, the phase expansion system or the like, as described above, which operates so as to either suppress potential drops on video signal lines due to fieldthrough phenomenon, which is a problem caused by turning on/off transistors used in switches coupled to the video signal lines, or extend a short device life of the switches, which is a problem caused by turning on/off the transistors, and the invention also aims to provide a drive method therefor.

Solution to the Problems

A first aspect of the present invention is directed to an active-matrix display device with a plurality of pixel formation portions for forming an image to be displayed, a plurality of video signal lines for transmitting signals representing the image to be displayed, and a plurality of scanning signal lines crossing the video signal lines, the plurality of pixel formation portions being arranged in a matrix so as to correspond to their respective intersections of the video signal lines and the scanning signal lines, the device comprising:

a scanning signal line drive circuit for selectively driving the scanning signal lines;

a video signal line drive circuit for driving the video signal lines by applying image signals inputted as the signals representing the image to be displayed, in predetermined order via a plurality of groups of switch elements, each group being provided so as to correspond to one of the video signal lines and consisting of a plurality of switch elements connected in parallel; and a display control circuit for controlling the switch elements such that at least one of the switch elements in the same group is on during a period required for providing a corresponding image signal to a corresponding video signal line, and a time point at which a part of the switch elements in the same group is turned off varies from a time point at which the remaining switch elements are turned off.

In a second aspect of the present invention, based on the first aspect of the invention, the video signal line drive circuit includes:

a video signal output circuit for outputting video signals from a plurality of output terminals in a time-division manner within a predetermined period, the output terminals respectively corresponding to a plurality of video signal line groups into which the video signal lines are divided, the video signals being transmitted by the video signal line groups corresponding to the output terminals; and a connection changeover circuit including the switch elements to connect the output terminals of the video signal output circuit to any video signal lines in the video signal line groups each corresponding to one of the output terminals, thereby providing the video signals to any pixel formation portions coupled to the connected video signal lines and the scanning signal lines selected by the scanning signal line drive circuit, the switch elements being operable such that, for each of the video signal line groups, the video signal lines to be connected to the output terminals corresponding to that the video signal line group are switched in accordance with the time-division.

In a third aspect of the present invention, based on the second aspect of the invention, the video signal output circuit has a plurality of output terminals corresponding to their respective video signal line groups into which the video signal lines are divided, each group consisting of three adjacent video signal lines respectively coupled to three varieties of pixel formation portions for displaying three predetermined primary colors.

In a fourth aspect of the present invention, based on any one of the first through third aspects of the invention, the switch elements are thin-film transistors each having a semiconductor layer made of microcrystalline silicon, amorphous silicon or an oxide semiconductor.

In a fifth aspect of the present invention, based on any one of the first through fourth aspects of the invention, the display control circuit controls the switch elements such that, for each horizontal scanning period, the switch elements in the same group are turned on at approximately the same time, with a part of the group being the last to be turned off.

In a sixth aspect of the present invention, based on the fifth aspect of the invention, the switch elements are thin-film transistors each having a semiconductor layer and the last part to be turned off among the switch elements in the same group is smaller than the remaining switch elements.

In a seventh aspect of the present invention, based on any one of the first through fourth aspects of the invention, the display control circuit controls the switch elements such that a part of the switch elements in the same group is turned on for each horizontal scanning period, and the sum total of on periods for each full horizontal scanning period or more is approximately equalized among the switch elements in the same group.

In an eighth aspect of the present invention, based on any one of the first through seventh aspects of the invention, during all or part of an off period, the display control circuit provides the switch elements in the same group with a predetermined potential of a sign opposite to an on potential provided during an on period.

In a ninth aspect of the present invention, based on the eighth aspect of the invention, the display control circuit provides at least one of the switch elements in the same group with the predetermined potential of the opposite sign during all or part of the off period for the at least one switch element while one or more of the remaining switch elements in the same group, excluding the at least one switch element, are on.

A tenth aspect of the present invention is directed to a liquid crystal display device wherein pixel formation portions of any one of claims 1 through 9 include liquid crystal elements.

An eleventh aspect of the present invention is directed to a method for driving an active-matrix display device with a plurality of pixel formation portions for forming an image to be displayed, a plurality of video signal lines for transmitting signals representing the image to be displayed, and a plurality of scanning signal lines crossing the video signal lines, the plurality of pixel formation portions being arranged in a matrix so as to correspond to their respective intersections of the video signal lines and the scanning signal lines, the method comprising:

a scanning signal line drive step for selectively driving the scanning signal lines;

a video signal line drive step for driving the video signal lines by applying image signals inputted as the signals representing the image to be displayed, in predetermined order via a plurality of groups of switch elements, each group being provided so as to correspond to one of the video signal lines and consisting of a plurality of switch elements connected in parallel; and a display control step for controlling the switch elements such that at least one of the switch elements in the same group is on during a period required for providing a corresponding image signal to a corresponding video signal line, and a time point at which a part of the switch elements in the same group is turned off varies from a time point at which the remaining switch elements are turned off.

Effect of the Invention

According to the first aspect of the present invention, at least one of the switch elements in the same group on the display control circuit is controlled to be on during a period required for providing a corresponding image signal to a corresponding video signal line, and a time point at which a part of the switch elements in the same group is turned off is controlled to vary from a time point at which the remaining switch elements are turned off, thereby making it possible to achieve display devices employing, for example, the dot-sequence driving system, the video signal line time-division driving system, the phase expansion driving system, etc., which allow either suppression of potential drops on video signal lines due to fieldthrough phenomenon, which is a problem caused by turning on/off transistors used in switch elements coupled to the video signal lines, or extension of short device life, which is a problem caused by turning on/off the transistors.

According to the second aspect of the present invention, by employing the video signal line time-division driving system, it becomes possible to increase the pitch between connections of output terminals to video signal lines in display devices, and it also becomes possible to either suppress potential drops on video signal lines due to fieldthrough phenomenon, which is a problem caused by turning on/off transistors used in switch elements coupled to the video signal lines, or extend short device life, which is a problem caused by turning on/off the transistors.

According to the third aspect of the present invention, it is possible to achieve color display devices with video signal lines being divided into groups, each consisting of three adjacent video signal lines respectively coupled to three varieties of pixel formation portions for displaying three predetermined primary colors, which allow either suppression of potential drops on video signal lines due to fieldthrough phenomenon, which is a problem caused by turning on/off transistors used in switch elements coupled to the video signal lines, or extension of short device life, which is a problem caused by turning on/off the transistors.

According to the fourth aspect of the present invention, since the switch elements are thin-film transistors each having a semiconductor layer made of microcrystalline silicon, amorphous silicon or an oxide semiconductor, it is possible to sufficiently suppress the impact of fieldthrough phenomenon, which tends to increase especially due to parasitic capacitance of the elements becoming comparatively high to achieve a sufficient drive rate, and it is also possible to sufficiently extend device life, which tends to be short because the threshold voltage shift occurs relatively easily.

According to the fifth aspect of the present invention, the display control circuit controls the switch elements such that, for each horizontal scanning period, the switch elements in the same group are turned on at approximately the same time, with a part of the group being the last to be turned off, so that only the parasitic capacitance of the last switch element to be turned off has impact, and therefore it is possible to suppress potential drops on video signal lines due to fieldthrough phenomenon.

According to the sixth aspect of the present invention, since the switch elements are thin-film transistors each having a semiconductor layer and the last part to be turned off among the switch elements in the same group is smaller than the remaining switch elements, it is possible to further reduce the parasitic capacitance of the last switch element to be turned off, thereby further suppressing potential drops on video signal lines due to fieldthrough phenomenon.

According to the seventh aspect of the present invention, since the display control circuit controls the switch elements such that a part of the switch elements in the same group is turned on for each horizontal scanning period, and the sum total of on periods for each full horizontal scanning period or more is approximately equalized among the switch elements in the same group, it is possible to reduce the on period per switch element which is a transistor, thereby extending the device life thereof.

According to the eighth aspect of the present invention, since during all or part of an off period, the display control circuit provides the switch elements in the same group with a predetermined potential of a sign opposite to an on potential provided during an on period, it is possible to suppress threshold voltage shift (beyond a normal range) caused by continuously applying a voltage of the same sign, thereby extending device life.

According to the ninth aspect of the present invention, since the display control circuit provides at least one of the switch elements in the same group with the predetermined potential of the opposite sign during all or part of the off period for the at least one switch element while one or more of the remaining switch elements in the same group, excluding the at least one switch element, are on, leakage current that flows from the at least one switch element due to the potential of the opposite sign being provided is rendered negligible.

According to the tenth aspect of the present invention, the effects achieved by the first through ninth aspects of the invention can be achieved in liquid crystal display devices.

According to the eleventh aspect of the present invention, an effect similar to that achieved by the first aspect of the invention can be achieved in drive methods for display devices.

BEST MODE FOR CARRYING OUT THE INVENTION

Hereinafter, embodiments of the present invention will be described with reference to the accompanying drawings.

<1. First Embodiment>

<1.1 Overall Configuration and Operation of the Liquid Crystal Display Device>

Figure 1A:
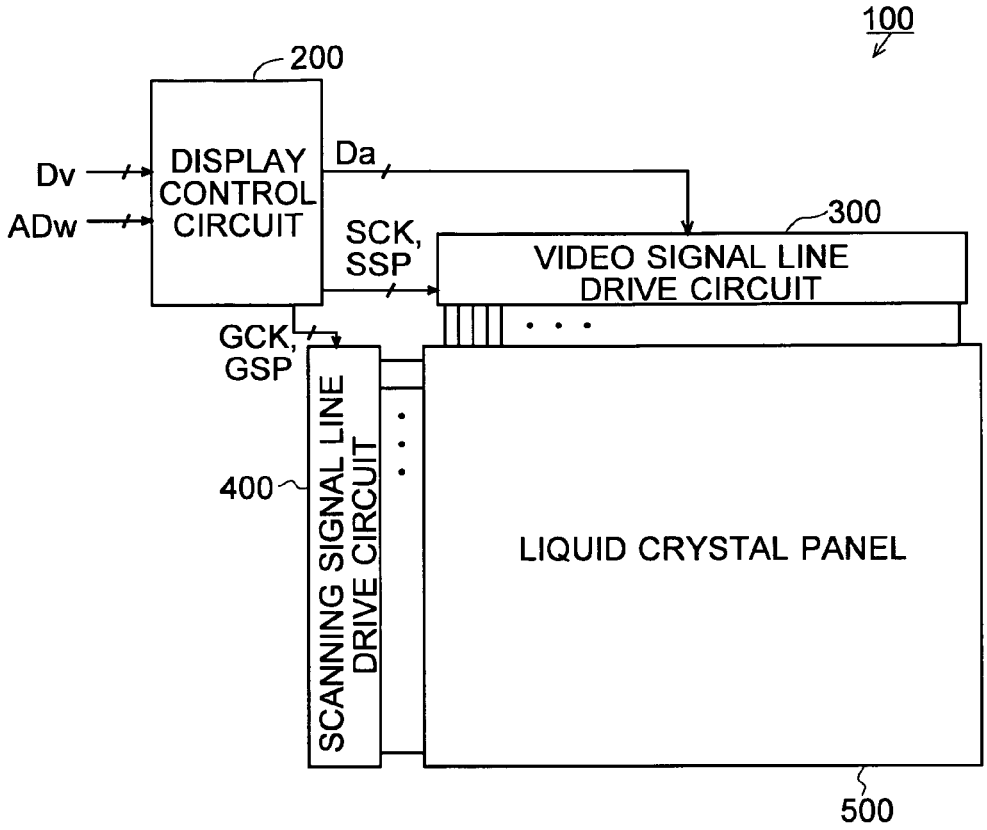
FIG. 1A is a block diagram illustrating the configuration of a liquid crystal display device according to a first embodiment of the present invention.

FIG. 1A is a block diagram illustrating the configuration of a liquid crystal display device according to a first embodiment of the present invention. This liquid crystal display device 100 includes a display control circuit 200, a video signal line drive circuit (also referred to as a "column electrode drive circuit" or a "source driver") 300, a scanning signal line drive circuit (also referred to as a "row electrode drive circuit" or a "gate driver") 400, and an active-matrix liquid crystal panel 500.

As a display portion of the liquid crystal display device 100, the liquid crystal panel 500 includes a plurality of scanning signal lines (row electrodes) corresponding to horizontal scanning lines in an image represented by image data Dv received from a CPU or suchlike in an external computer, a plurality of video signal lines (column electrodes) crossing the scanning signal lines, and a plurality of pixel formation portions provided at their corresponding intersections of the scanning signal lines and the video signal lines. The configuration of each pixel formation portion is basically the same as in conventional active-matrix liquid crystal panels (details will be described later).

In the present embodiment, (narrow-sense) image data, which represents an image to be displayed on the liquid crystal panel 500, and data which sets the timing of display operation (e.g., data which indicates a display clock frequency) (hereinafter, referred to as "display control data") are sent from the CPU or suchlike in the external computer to the display control circuit 200 (hereinafter, the data Dv sent from the external is referred to as "broad-sense image data"). Specifically, the external CPU or suchlike supplies the (narrow-sense) image data and the display control data, which are included in the broad-sense image data Dv, to the display control circuit 200 along with an address signal ADw, so that the image data and the display control data are written to display memory and a register, respectively, which will be described later, within the display control circuit 200.

Based on the display control data written to the register, the display control circuit 200 generates various signals, including a source clock signal SCK and a source start pulse signal SSP, which are provided to the video signal line drive circuit 300 for the purpose of display, as well as a gate clock signal GCK and a gate start pulse signal GSP, which are provided to the scanning signal line drive circuit 400 for the purpose of display. These are known signals and therefore any detailed descriptions thereof are omitted. Also, the display control circuit 200 reads the (narrow-sense) image data written to the display memory by the external CPU or suchlike from the display memory and outputs the data as a digital image signal Da. In addition, the display control circuit 200 generates changeover control signals $GS_{1a}$ to $GS_{3b}$ for time-division driving of the video signal lines (these signals will be also referred to below as "changeover control signals GS"), and outputs them as well.

In this manner, as for the signals generated by the display control circuit 200, the digital image signal Da is supplied to the video signal line drive circuit 300, and the changeover control signals $GS_{1a}$ to $GS_{3b}$ are supplied to the video signal line drive circuit 300 and also to a connection changeover circuit in the liquid crystal panel 500 to be described later. Note that the number of signal lines provided for supplying the digital image signal Da from the display control circuit 200 to the video signal line drive circuit 300 corresponds to the number of tones of a display image.

As described above, data representing an image to be displayed on the liquid crystal panel 500 is serially supplied to the video signal line drive circuit 300 in units of pixels as the digital image signal Da, along with the source clock signal SCK and the source start pulse signal SSP, which are timing indication signals, as well as the changeover control signal GS. Based on the digital image signal Da, the source clock signal SCK, the source start pulse signal SSP and the changeover control signal GS, the video signal line drive circuit 300 generates a video signal for driving the liquid crystal panel 500 (hereinafter, also referred to as a "drive video signal"), and applies the signal to each video signal line of the liquid crystal panel 500.

Based on the gate clock signal GCK and the gate start pulse signal GSP, the scanning signal line drive circuit 400 generates scanning signals $G_1, G_2, G_3, \ldots$, to be applied to the scanning signal lines of the liquid crystal panel 500 to sequentially select each of the scanning signal lines for one horizontal scanning period, and repeatedly applies active scanning signals to the scanning signal lines in cycles of one vertical scanning period in order to sequentially select all the scanning signal lines.

As described above, the video signal line drive circuit 300 applies drive video signals $S_1, S_2, S_3, \ldots$, to the video signal lines of the liquid crystal panel 500 based on the digital image signal Da, and the scanning signal line drive circuit 400 applies the scanning signals $G_1, G_2, G_3, \ldots$, to the scanning signal lines. As a result, the liquid crystal panel 500 displays the image represented by the image data Dv received from the external CPU or suchlike.

<1.2 Display Control Circuit>

Figure 1B:
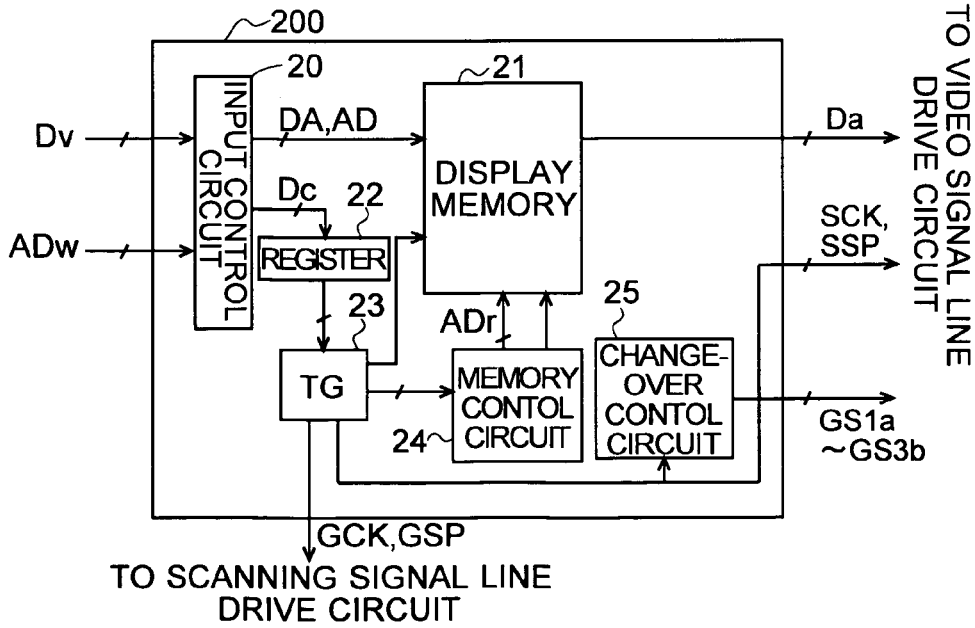
FIG. 1B is a block diagram illustrating the configuration of a display control circuit of the liquid crystal display device according to the embodiment.

FIG. 1B is a block diagram illustrating the configuration of the display control circuit 200 of the liquid crystal display device 100. The display control circuit 200 includes an input control circuit 20, display memory 21, a register 22, a timing generation circuit 23, a memory control circuit 24, and a changeover control circuit 25.

A signal which indicates broad-sense image data Dv (hereinafter, the signal will also be denoted by the characters "Dv") and an address signal ADw are received from the external CPU or suchlike by the display control circuit 200, and inputted to the input control circuit 20. Based on the address signal ADw, the input control circuit 20 classifies the broad-sense image data Dv into image data DA and display control data Dc. Then, a signal which represents the image data DA (hereinafter, the signal will also be denoted by the characters "DA") is supplied to the display memory 21, along with an address signal AD based on the address signal ADw, so that the image data DA is written to the display memory 21 and the display control data Dc is written to the register 22. The display control data Dc contains timing information which specifies frequencies of clock signals, including the source clock signal SCK, and horizontal and vertical scanning periods for displaying the image represented by the image data Dv.

The timing generation circuit (hereinafter, abbreviated as "TG") 23 generates a source clock signal SCK and a source start pulse signal SSP based on the display control data being held in the register 22. Also, the TG 23 generates a timing signal for causing the display memory 21 and the memory control circuit 24 to operate in synchronization with the source clock signal SCK.

The memory control circuit 24 generates an address signal ADr for reading data which represents an image to be displayed on the liquid crystal panel 500 from the image data DA which is externally inputted and stored to the display memory 21 via the input control circuit 20, and the memory control circuit 24 also generates a signal for controlling the operation of the display memory 21. The address signal ADr and the control signal are provided to the display memory 21, so that the data which represents an image to be displayed on the liquid crystal panel 500 is read from the display memory 21 as a digital image signal Da, which is outputted from the display control circuit 200. The digital image signal Da is supplied to the video signal line drive circuit 300, as has already been described.

The changeover control circuit 25 generates changeover control signals $GS_{1a}$ to $GS_{3b}$ for time-division driving of the video signal lines, based on the timing signal from the TG 23. The changeover control signals $GS_{1a}$ to $GS_{3b}$ are control signals for switching video signal lines to which the video signal outputted from the video signal line drive circuit 300 should be applied, for each full horizontal scanning period or less to drive the video signal lines in a time-division manner, as will be described later.

Figure 5:
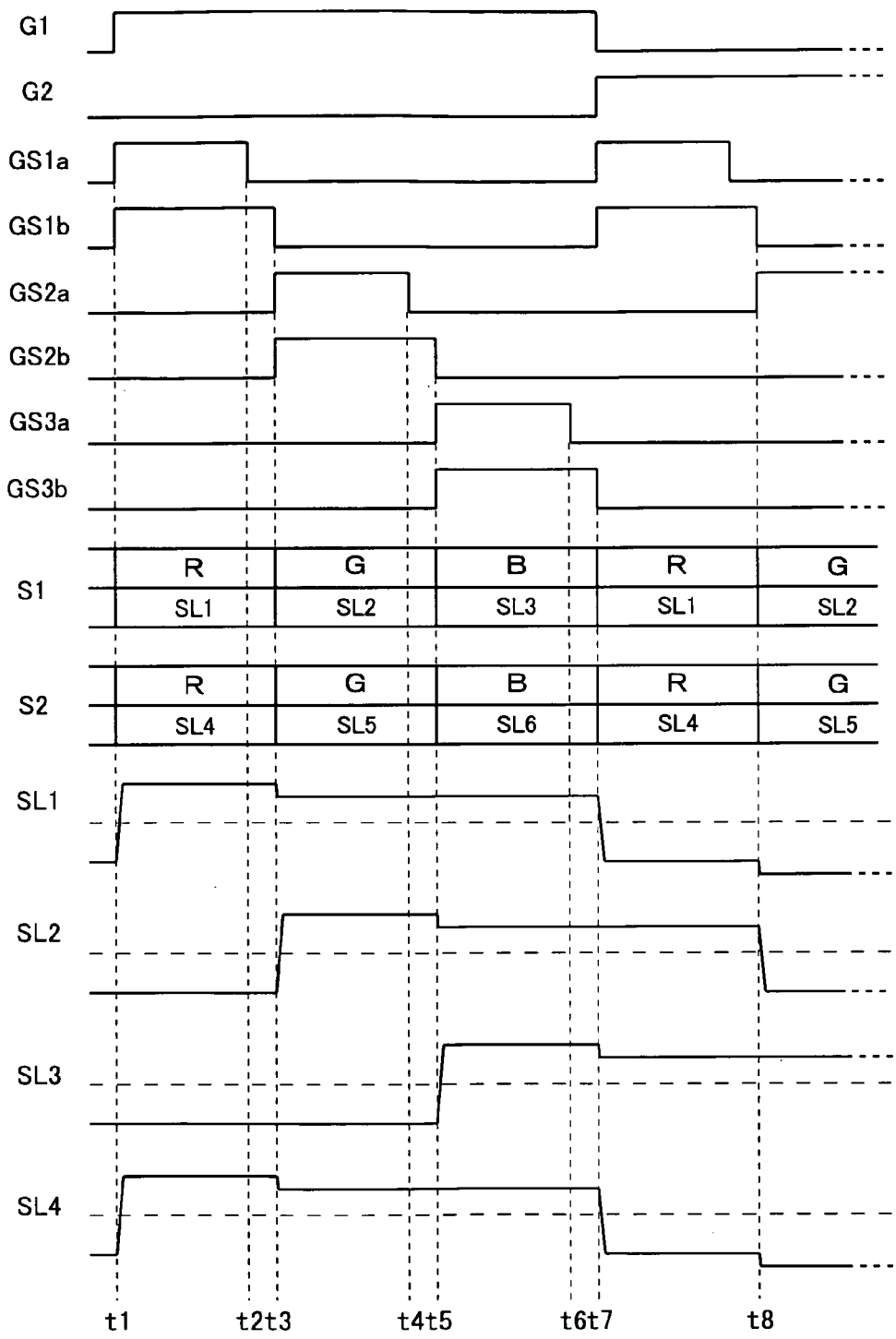
FIG. 5 is a timing chart describing a drive method for the liquid crystal display device in the embodiment.

In the present embodiment, as shown in FIG. 5 to be described later, where each horizontal scanning period (a period in which the scanning signal is activated) is typically divided into three equal portions, first to third periods, a signal to be set at H level during the first period and at L level during the other periods is generated as a changeover control signal $GS_{1b}$, and a signal to be set at H level from the start of the first period to a point slightly preceding the end (i.e., during a period slightly shorter than the first period) and at L level during the other periods is generated as a changeover control signal $GS_{1a}$; similarly, a signal to be set at H level during the second period and at L level during the other periods is generated as a changeover control signal $GS_{2b}$, and a signal to be set at H level during a period slightly shorter than the second period and at L level during the other periods is generated as a changeover control signal $GS_{2a}$; and similarly still, a signal to be set at H level during the third period and at L level during the other periods is generated as a changeover control signal $GS_{3b}$, and a signal to be set at H level during a period slightly shorter than the third period and at L level during the other periods is generated as a changeover control signal $GS_{3a}$. Note that the aforementioned length of the first to third periods is set for the sake of convenient explanation, and in practice, the horizontal scanning period is not necessarily divided into three equal portions, such that an idle period is provided after the third period and before the signal is stabilized.

<1.3 Liquid Crystal Panel and Drive Method Therefor>

<1.3.1 Configuration of the Liquid Crystal Panel>

Figure 2:
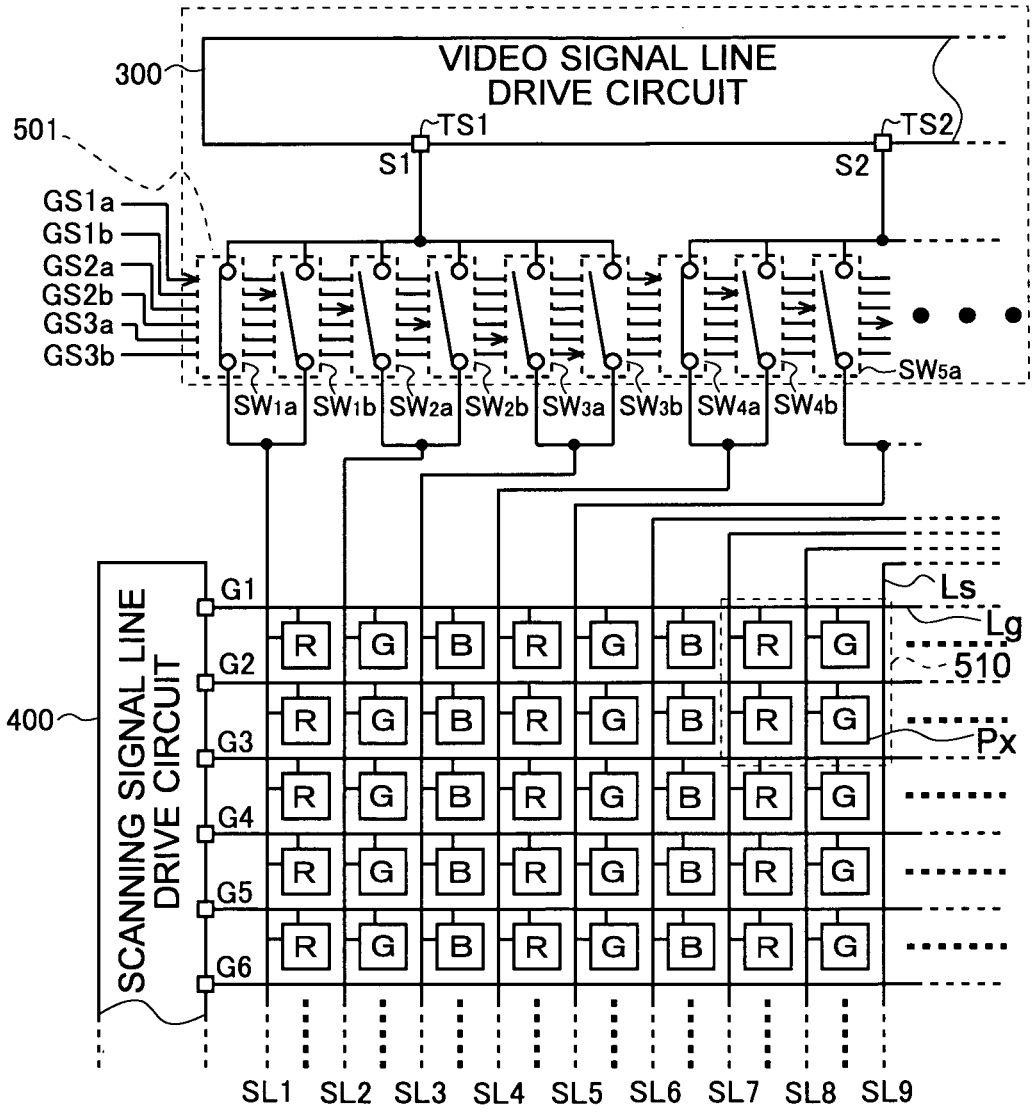
FIG. 2 is a schematic diagram illustrating the configuration of a liquid crystal panel in the embodiment.
Figure 3:
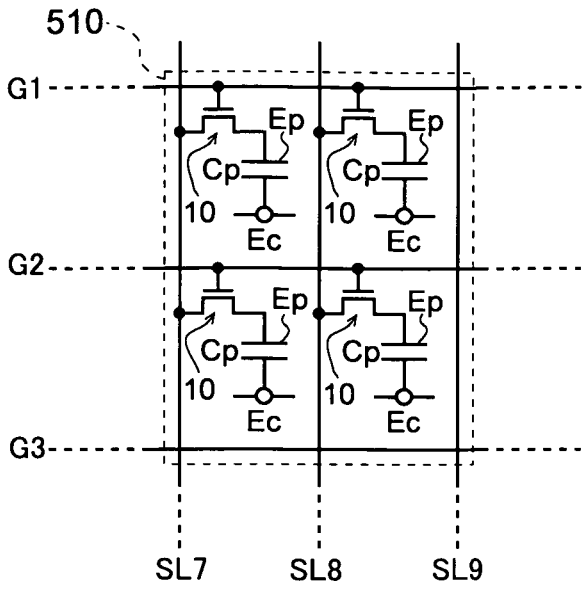
FIG. 3 is an equivalent circuit diagram of a portion (corresponding to four pixels) of the liquid crystal panel in the embodiment.
Figure 4:
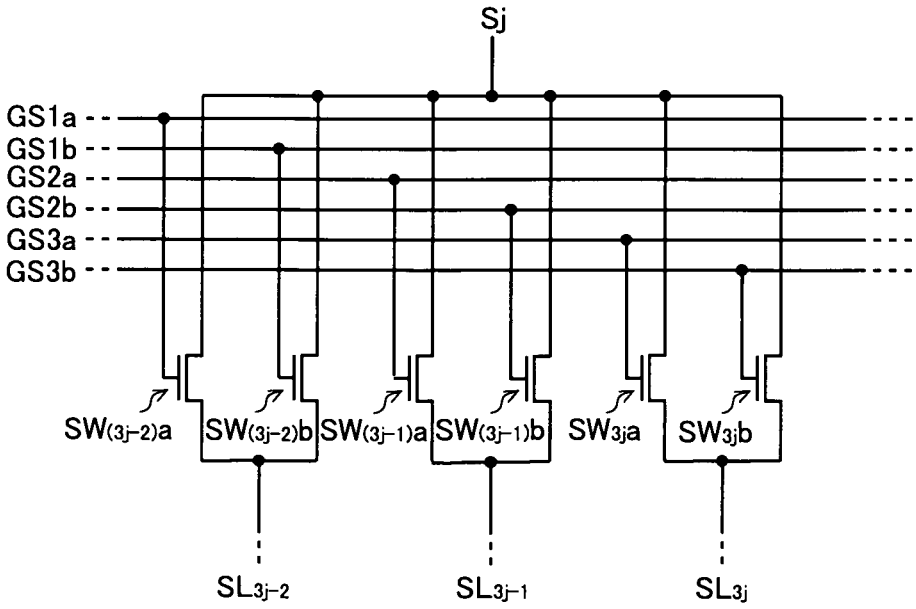
FIG. 4 is an equivalent circuit diagram illustrating changeover switches included in a connection changeover circuit of the liquid crystal panel in the embodiment.

FIG. 2 is a schematic diagram illustrating the configuration of the liquid crystal panel 500 in the present embodiment, FIG. 3 is an equivalent circuit diagram of a portion (corresponding to four pixels) 510 of the liquid crystal panel, and FIG. 4 is an equivalent circuit diagram illustrating changeover switches included in a connection changeover circuit 501 of the liquid crystal panel to be described later.

The liquid crystal panel 500 includes a plurality of video signal lines Ls connected to the video signal line drive circuit 300 via the connection changeover circuit 501 including switch elements $SW_{1a}$, $SW_{1b}$, $SW_{2a}$, $SW_{2b}$, . . . , and also includes a plurality of scanning signal lines Lg connected to the scanning signal line drive circuit 400, such that the video signal lines Ls and the scanning signal lines Lg are arranged in a grid-like formation so as to cross each other. As have already been described, a plurality of pixel formation portions Px are provided at their corresponding intersections of the video signal lines Ls and the scanning signal lines Lg. Each pixel formation portion Px includes a TFT 10 having a source terminal connected to the video signal line Ls crossing its corresponding intersection, a pixel electrode Ep connected to a drain terminal of the TFT 10, an opposing electrode Ec commonly provided for the pixel formation portions Px, and a liquid crystal layer commonly provided for the pixel formation portions Px between the pixel electrode Ep and the opposing electrode Ec, as shown in FIG. 3. Also, the pixel electrode Ep, the opposing electrode Ec and the liquid crystal layer provided therebetween form pixel capacitance Cp.

The pixel formation portions Px as described above are arranged in a matrix to form a pixel formation matrix. Incidentally, the pixel electrode Ep, which is a principal part of each pixel formation portion Px, is in one-to-one correspondence with a pixel of an image to be displayed on the liquid crystal panel and therefore can be identified therewith. Accordingly, hereinafter, the pixel formation portions Px will be identified with pixels for convenience of explanation, and the "pixel formation matrix" will also be referred to as the "pixel matrix".

In FIG. 2, "R", "G" or "B" assigned to each pixel formation portion Px denotes red, green or blue, the color of a pixel formed by the pixel formation portion Px. Note that these colors are three basic primary colors but three other primary colors may be used. Also, in general liquid crystal display devices, polarity inversion drive is performed to suppress deterioration of liquid crystal and maintain display quality, and the present embodiment employs a typical polarity inversion driving system called a line inversion driving system, in which the polarity of a voltage applied to the liquid crystal layer for pixel formation is reversed per scanning signal line and also per frame. Also, instead of employing the line inversion driving system, a frame inversion driving system, which is a driving system in which the polarity of a voltage applied to a liquid crystal of a pixel is only reversed per frame, or a so-called dot inversion driving system in which the reversal is performed per scanning signal line and also per video signal line (the reversal also being performed per frame) may be employed.

The connection changeover circuit 501, including the switch elements $SW_{1a}$, $SW_{1b}$, $SW_{2a}$, $SW_{2b}$, $SW_{3a}$, $SW_{3b}$, . . . , which correspond to their respective video signal lines Ls on the liquid crystal panel, is formed on the liquid crystal panel to connect the video signal lines Ls to the video signal line drive circuit 300 (FIG. 2), as described above, and the switch elements $SW_{1a}$, $SW_{1b}$, $SW_{2a}$, $SW_{2b}$, $SW_{3a}$, $SW_{3b}$, . . . , are put into switch element groups (the number of which is ⅙ of the number of video signal lines Ls) each consisting of six adjacent elements. Six switch elements included in each group are further divided into pairs of adjacent elements connected to the same video signal line. Specifically, switch elements $SW_{ia}$ and $SW_{ib}$ (i=1, 2, 3, . . . ) in each pair are connected at one end to the same video signal line Ls corresponding to the switch elements $SW_{ia}$ and $SW_{ib}$ (hereinafter, also collectively referred to as the "switch elements $SW_i$") and at the other end to such other ends of other switch elements in the same group as the switch elements $SW_i$ and also to one output terminal $TS_j$ (j=1, 2, 3, . . . ) of the video signal line drive circuit 300. In this manner, the video signal lines Ls of the liquid crystal panel are put into a plurality of video signal line groups each consisting of three lines, and each video signal line group (three grouped video signal lines Ls) is connected to one output terminal TS; of the video signal line drive circuit 300 via six grouped switch elements. In this manner, each output terminal TS; of the video signal line drive circuit 300 is in one-to-one correspondence with its video signal line group and connected to grouped video signal lines (three video signal lines Ls) via six grouped switch elements.

Here, the switch elements $SW_i$ are formed on the glass substrate of the liquid crystal panel using thin-film transistors (TFTs) configured in a well-known manner with semiconductor layers of, for example, microcrystalline silicon (μc-Si), amorphous silicon (a-Si), or an oxide semiconductor such as zinc oxide (ZnO), and six grouped switch elements $SW_{(3j-2)a}$, $SW_{(3j-2)b}$, $SW_{(3j-1)a}$, $SW_{(3j-1)b}$, $SW_{3ja}$, and $SW_{3b}$ (j=1, 2, 3, . . . ) are configured to be turned on/off in accordance with changeover control signals $GS_{1a}$ to $GS_{3b}$, as shown in FIG. 4. Also, the switch elements are paired as $SW_{(3j-2)a}$ and $SW_{(3j-2)b}$, $SW_{(3j-1)a}$ and $SW_{(3j-1)b}$, and $SW_{3ja}$ and $SW_{3b}$, and connected in parallel, and when one of the two in each pair is turned on, their opposite terminals become conductive. In this manner, the six grouped switch elements shown in FIG. 4 form three pairs of changeover switches, which provide time-division connection of the output terminal $TS_j$ (from an LSI chip) of the video signal line drive circuit 300 formed in the LSI chip typically mounted on the liquid crystal panel to three video signal lines in the video signal line group corresponding to the output terminal.

The switch elements $SW_i$ are n-channel TFTs each having a gate terminal at which its corresponding one of the changeover control signals $GS_{1a}$ to $GS_{3b}$ is received, and when the received one of the changeover control signals $GS_{1a}$ to $GS_{3b}$ is at H level, the TFT becomes conductive between its drain and source. Also, as will be described later, the six grouped switch elements $SW_{(3j-2)a}$, $SW_{(3j-2)b}$, $SW_{(3j-1)a}$, $SW_{(3j-1)b}$, $SW_{3ja}$, and $SW_{3b}$ are sequentially turned on two by two in accordance with the changeover control signals $GS_{1a}$ to $GS_{3b}$, with the remaining four being rendered off. However, two switch elements $SW_{ia}$ and $SW_{ib}$ in each pair are turned off at different times, as will be described later.

Here, as the switch elements $SW_i$, the TFTs are formed in smaller size, specifically, narrower channel width, than conventional in order to reduce as much as possible parasitic capacitance Cgd which causes fieldthrough phenomenon. Therefore, a single TFT alone does not have sufficient driving performance for driving the video signal line. However, the video signal line is driven by two switch elements $SW_{ia}$ and $SW_{ib}$ for a predetermined period of time, as will be described later, resulting in a sufficient drive rate. Hereinafter, a drive method for the instant liquid crystal display device 100 will be described with reference to FIG. 5, including the aforementioned switch element changeover operation.

<1.3.2 Drive Method>

FIG. 5 is a timing chart describing a drive method for the instant liquid crystal display device. As shown in FIG. 5, the scanning signal lines Lg of the liquid crystal panel have applied thereto their respective scanning signals $G_1$, $G_2$, . . . , which are sequentially set to H level for one horizontal scanning period (a period in which one scanning line is selected). The scanning signal lines Lg are brought into selected (activated) state upon application of such scanning signals $G_1$, $G_2$, . . . , at H level, so that the TFTs 10 of the pixel formation portions Px connected to the scanning signal lines Lg in selected state are brought into on state, while the scanning signal lines Lg are brought into deselected (deactivated) state upon L-level signal application, so that the TFTs 10 of the pixel formation portions Px connected to the scanning signal lines Lg in deselected state are brought into off state. Note that the waveforms shown in FIG. 5 are represented in a simplified manner, and differ from the actual form of change.

Here, as shown in FIG. 5, the changeover control signal $GS_{1b}$ is set at H level during the first (a period from time $t_1$ to time $t_3$ in the figure) of three portions, typically first through third equal portions, of each horizontal scanning period (a period in which the scanning signal $G_k$ (k=1, 2, 3, . . . ) is set at H level), and the changeover control signal $GS_{1b}$ is set at L level during the rest of the time, i.e., the second and third portions, (a period from time $t_3$ to time $t_7$ in the figure).

In this manner, one of the switch elements in the connection changeover circuit 501 that is connected to the (3j-2)'th video signal line Ls (in the figure, j=1, 2), i.e., the switch element $SW_{(3j-2)b}$, is turned on when the changeover control signal $GS_{1b}$ is at H level and off when the changeover control signal $GS_{1b}$ is at L level. In this case, the switch element $SW_{(3j-2)a}$, which is connected in parallel to and paired with the switch element $SW_{(3j-2)b}$, is turned on when the changeover control signal $GS_{1a}$ is at H level and off when the changeover control signal $GS_{1a}$ is at L level. Here, as shown in FIG. 5, the changeover control signal $GS_{1b}$ is always at H level when the changeover control signal $GS_{1a}$ is at H level, and therefore the switch element $SW_{(3j-2)b}$ is conductive at its opposite terminals during its on period, regardless whether the switch element $SW_{(3j-2)a}$ is on or off. This feature of the switch element $SW_{(3j-2)a}$ will be described in detail later.

Also, the switch element $SW_{(3j-1)b}$ connected to the (3j-1)'th video signal line Ls is turned on when the changeover control signal $GS_{2b}$ is at H level and off when the changeover control signal $GS_{2b}$ is at L level. Note that the switch element $SW_{(3j-1)a}$ paired with the switch element $SW_{(3j-1)b}$ has a feature similar to the aforementioned feature of the switch element $SW_{(3j-2)a}$. In addition, the switch element $SW_{3jb}$ connected to the 3j'th video signal line Ls is turned on when the changeover control signal $GS_{3a}$ is at H level and off when the changeover control signal $GS_{3a}$ is at L level. Note that the switch element $SW_{3ja}$ paired with the switch element $SW_{3jb}$ has a feature similar to the aforementioned feature of the switch element $SW_{(3j-2)a}$.

Accordingly, the output terminal $TS_j$ of the video signal line drive circuit 300 is connected to the (3j-2)'th video signal line Ls during the first portion of each horizontal scanning period, to the (3j-1)'th video signal line Ls during the second portion of each horizontal scanning period, and to the (3j-2)'th video signal line Ls during the third portion of each horizontal scanning period. In this regard, it is similar to the operation of conventional liquid crystal display devices employing the time-division driving system, but the aforementioned operations of the switch elements $SW_{(3j-2)a}$, $SW_{(3j-1)a}$, and $SW_{3ja}$ suppress the aforementioned impact of fieldthrough phenomenon. Hereinafter, the operations of the switch elements $SW_{(3j-2)a}$, $SW_{(3j-1)a}$, and $SW_{31ja}$ will be described in detail with further reference to FIG. 5, along with various signal waveforms for the time-division driving system.

In the timing chart of FIG. 5, video signals $S_1$ and $S_2$ to be outputted from output terminals $TS_1$ and $TS_2$, respectively, of the video signal line drive circuit 300 are each represented by two portions, upper and lower, with the upper portion indicating (pixel values for) colors to be displayed in the pixel formation portions Px by the video signal, $S_1$, $S_2$, and the lower portion indicating video signal lines to which the video signal, $S_1$, $S_2$, should be applied.

To output such video signals, the video signal line drive circuit 300, first, sequentially receives pixel values (here, pixel values for displaying "R") to be written to pixel formation portions Px in the (3j-2)'th pixel column of the pixel matrix that have their TFTs 10 turned on by scanning signals $G_k$, from the display control circuit 200, and then outputs video signals $S_j$ corresponding to the pixel values from the output terminals $TS_j$ during the first portion (in FIG. 5, a period from time $t_1$ to time $t_3$) of the horizontal scanning period.

Here, at time $t_1$ shown in FIG. 5, two paired switch elements $SW_{(3j-2)a}$ and $SW_{(3j-2)b}$ (here, $SW_{1a}$ and $SW_{1b}$) connected in parallel, as described above, are both turned on, and therefore (even if each unit is not sufficient by itself) the two exert sufficient current driving performance (a drive rate for image display), so that the potential of the video signal $S_1$ applied to the video signal line $SL_1$ changes toward a potential indicated by a pixel value at a sufficient rate (amount of change) for image display. Note that the two paired switch elements $SW_{(3j-2)a}$ and $SW_{(3j-2)b}$ do not have to be turned on at exactly the same time, so long as a sufficient rate for image display is achieved as a whole. Also, the potential of the video signal $S_j$ (here, $S_1$) is designed to reach the potential indicated by the pixel value before the end of the first period (in FIG. 5, time $t_3$) at the latest.

Subsequently, at time $t_2$, the switch element $SW_{(3j-2)a}$ (here, $SW_{1a}$) is turned off, but since the switch element $SW_{(3j-2)b}$ (here, $SW_{1b}$) remains on, the potential of the video signal $S_1$ continues to be applied to the video signal line $SL_1$. Accordingly, the potential drop on the video signal line $SL_1$ caused by fieldthrough phenomenon due to the parasitic capacitance Cgd of the switch element $SW_{(3j-2)a}$ (here, $SW_{1a}$) is instantly solved.

Next, at time $t_3$, the switch element $SW_{(3j-2)b}$ (here, $SW_{1b}$) is turned off, but since the switch element $SW_{(3j-2)a}$ (here, $SW_{1a}$) is already off, as shown in FIG. 5, the potential drop on the video signal line $SL_1$ is caused by fieldthrough phenomenon due to the parasitic capacitance Cgd of the switch element $SW_{(3j-2)b}$ (here, $SW_{1b}$), as is expected. Note that the waveforms shown in FIG. 5 are represented in a simplified manner, and differ from the actual amount and form of potential change.

However, as described above, in the present embodiment, the value of parasitic capacitance Cgd per switch element is lower when compared to the case where one switch element is provided per video signal line as in conventional display devices employing the video signal line time-division driving system, and therefore a charge stored in the parasitic capacitance Cgd, which is redistributed by the time the transistor is turned off, decreases, resulting in a reduced potential drop on the video signal line $SL_1$ caused by fieldthrough phenomenon. Thus, it is possible to suppress the impact of fieldthrough phenomenon.

Note that in the configuration of the present embodiment, the switch element $SW_{(3j-2)a}$ (here, $SW_{1a}$) is turned off at time $t_2$, and therefore the video signal line $SL_1$ has to be drivenby only the switch element $SW_{(3j-2)b}$ (here, $SW_{1b}$). However, at this point, the video signal line $SL_1$ has been almost completely charged (i.e., the potential has almost reached the potential indicated by the pixel value), and therefore no particular problem occurs because the switch element $SW_{(3j-2)b}$ (here, $SW_{1b}$) is not required to have high driving performance. Also, for this reason, the switch element $SW_{ib}$ may be formed smaller in size (concretely, channel width) than the switch element $SW_{ia}$ (i.e., the size of the TFT that is turned off later may be smaller) to such an extent that the driving performance does not cause any problem. By doing so, it becomes possible to further reduce the parasitic capacitance Cgd of the switch element $SW_{ib}$, resulting in further suppression of the impact of fieldthrough phenomenon.

Next, pixel values (here, pixel values for displaying "G") to be written to pixel formation portions Px in the (3j-1)'th pixel column of the pixel matrix that have their TFTs 10 turned on by scanning signals $G_k$ are sequentially inputted from the display control circuit 200, and then video signals $S_j$ corresponding to the pixel values are outputted from the output terminals $TS_j$ during the second portion (in FIG. 5, a period from time $t_3$ to time $t_5$) of the horizontal scanning period. While only the switch element $SW_{(3j-1)a}$ (here, $SW_{2a}$) is turned off at time $t_4$, this operation is similar to the operation described above for the first period, and therefore any description thereof will be omitted.

Subsequently, pixel values (here, pixel values for displaying "B") to be written to pixel formation portions Px in the 3j'th pixel column of the pixel matrix that have their TFTs 10 turned on by the scanning signals $G_k$ are sequentially inputted from the display control circuit 200, and then video signals $S_j$ corresponding to the pixel values are outputted from the output terminals $TS_j$ during the third portion (in FIG. 5, a period from time $t_6$ to time $t_8$) of the horizontal scanning period. Note that the operation of the switch element $SW_{3ja}$ (here, $SW_{3a}$) at time $t_7$ is also similar to the operation described above for the first period, and therefore any description thereof will be omitted. The operation as above is repeated every horizontal scanning period, so that one image is displayed on the liquid crystal panel 500 in one frame period.

<1.4 Effect>

As described above, in the present embodiment, the six grouped switch elements $SW_{(3j-2)a}$, $SW_{(3j-1)a}$, $SW_{3ja}$, $SW_{(3j-2)b}$, $SW_{(3j-1)b}$, and $SW_{3jb}$ with parasitic capacitance Cgd sufficiently reduced by decreasing TFTs in size (concretely, channel width) are paired such that two switch elements $SW_{ia}$ and $SW_{ib}$ in each pair are turned on at the same time and only the switch element $SW_{ia}$ is turned off immediately before the end of a charging period (any one of the aforementioned first through third periods) for the corresponding video signal line. As a result, it is possible to eliminate the impact of fieldthrough phenomenon due to the parasitic capacitance Cgd of the switch element $SW_{ia}$ and it is also possible to suppress the impact of fieldthrough phenomenon due to the parasitic capacitance Cgd of the switch element $SW_{ib}$ since the parasitic capacitance Cgd is low.

Note that when microcrystalline silicon (μc-Si), amorphous silicon (a-Si), or an oxide semiconductor such as zinc oxide (ZnO) is used for semiconductor layers of TFTs functioning as the switch elements, a significant effect can be achieved, making it possible to sufficiently suppress the impact of fieldthrough phenomenon, which tends to increase due to the parasitic capacitance Cgd becoming comparatively high to achieve a sufficient drive rate.

<2. Second Embodiment>

<2.1 Configuration and Operation of the Liquid Crystal Display Device>

A liquid crystal display device 100 according to a second embodiment of the present invention is configured in approximately the same manner as in the first embodiment, except for the configuration and operation of switch elements $SW_i$ of a liquid crystal panel, and the same elements are denoted by the same characters with any detailed descriptions thereof omitted.

Also, unlike in the first embodiment, TFTs functioning as the switch elements $SW_i$ are formed in the same size (concretely, channel width) as in conventional configurations, rather than in smaller size than conventional for the purpose of reducing parasitic capacitance Cgd. Therefore, each one of them alone has sufficient driving performance of driving the video signal line, but cannot suppress fieldthrough phenomenon by itself. In the present embodiment, however, the switch elements $SW_i$ operate to allow extension of short device life, which is another of their problems. Hereinafter, the operation of the switch elements $SW_i$ will be described with reference to FIG. 6, along with a method for driving the liquid crystal panel.

<2.2 Drive Method>

Figure 6:
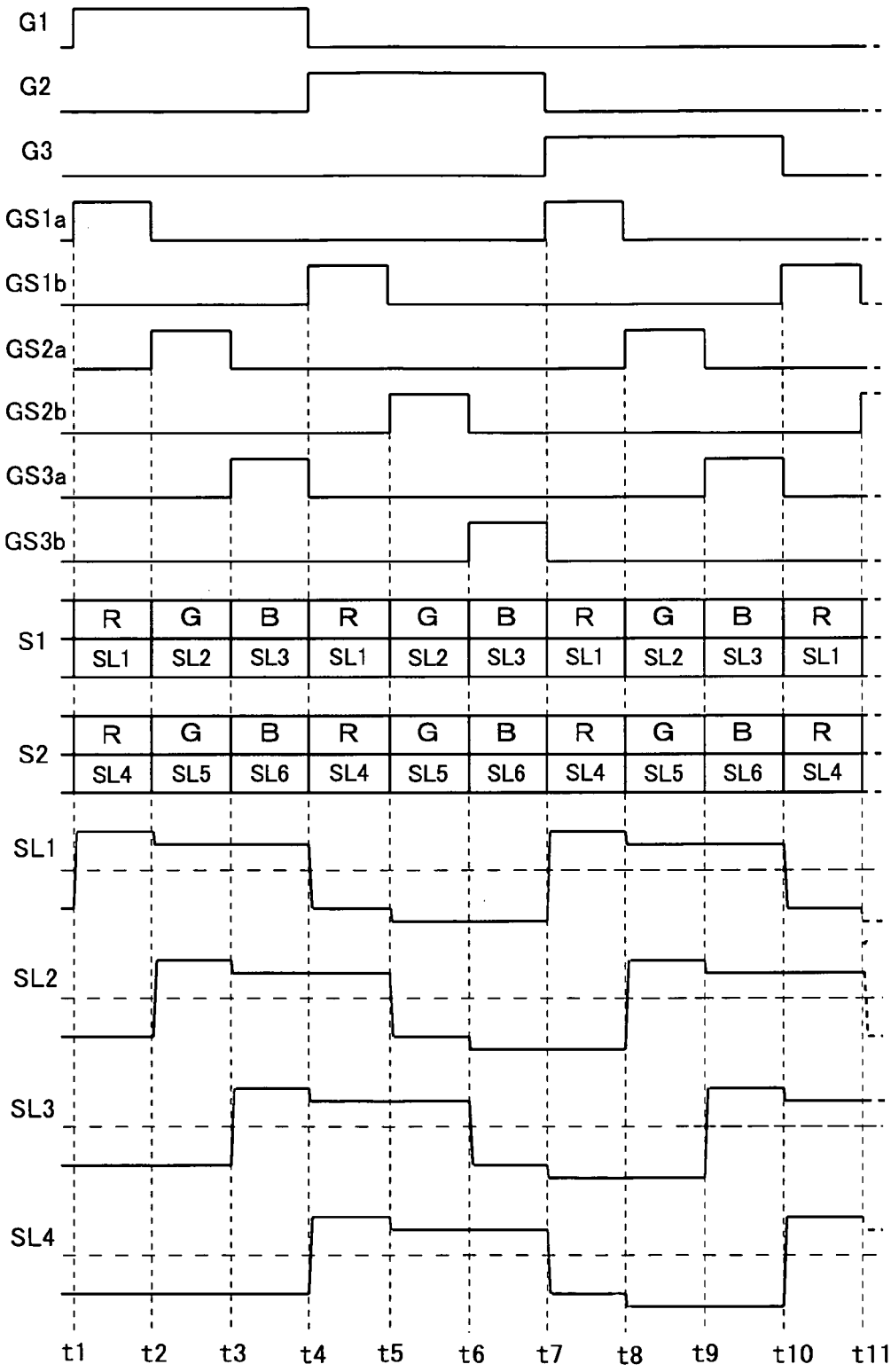
FIG. 6 is a timing chart describing a drive method for a liquid crystal display device according to a second embodiment of the present invention.

FIG. 6 is a timing chart describing the drive method for the instant liquid crystal display device 100. For various signals, other than changeover control signals $GS_{1a}$ to $GS_{3b}$ indicating the operation timing for switch elements $SW_{(3j-2)a}$, $SW_{(3j-1)a}$, and $SW_{3ja}$, as shown in FIG. 6, they are different in period from those shown in FIG. 5 but approximately the same in waveform, and therefore any detailed descriptions thereof will be omitted.

The changeover control signals $GS_{1a}$ and $GS_{1b}$ shown in FIG. 6, if combined, are the same as the changeover control signal $GS_{1b}$ shown in FIG. 5, and the changeover control signal $GS_{1a}$ is set at H level during the first portions (in the figure, a period from time $t_1$ to time $t_2$ and a period from time $t_7$ to time $t_8$) of odd-numbered horizontal scanning periods (periods in which scanning signals $G_k$ (k=1, 3, 5, . . . ) are set at H level) and at L level during the remaining periods. Also, the changeover control signal $GS_{1b}$ is set at H level during the first portions (in the figure, a period from time $t_4$ to time $t_5$ and a period from time $t_{10}$ to time $t_{11}$) of even-numbered horizontal scanning periods (periods in which scanning signals $G_k$ (k=2, 4, 6, . . . ) are set at H level) and at L level during the remaining periods.

Similarly, the changeover control signals $GS_{2a}$ and $GS_{2b}$ shown in FIG. 6, if combined, are the same as the changeover control signal $GS_{2b}$ shown in FIG. 5, and the changeover control signal $GS_{2a}$ is set at H level during the second portions of odd-numbered horizontal scanning periods and at L level during the remaining periods. Also, the changeover control signal $GS_{2b}$ is set at H level during the second portions of even-numbered horizontal scanning periods and at L level during the remaining periods.

In addition, the changeover control signals $GS_{3a}$ and $GS_{3b}$ shown in FIG. 6, if combined, are the same as the changeover control signal $GS_{3b}$ shown in FIG. 5, and the changeover control signal $GS_{3a}$ is set at H level during the third portions of odd-numbered horizontal scanning periods and at L level during the remaining periods. Also, the changeover control signal $GS_{3b}$ is set at H level during the third portions of even-numbered horizontal scanning periods and at L level during the remaining periods.

In this manner, two paired switch elements $SW_{ia}$ and $SW_{ib}$ connected in parallel are alternatingly turned on to play the same role as one conventional switch element. Accordingly, the number of times at which one switch element of the present embodiment is turned on is half the number for one conventional switch element, and therefore it is possible to extend device life, which in general becomes shorter as the number of on/off times increases. In particular, a time period in which one switch element is on is half the time period for one conventional switch element, and therefore it is possible to suppress threshold voltage shift (beyond a normal range) caused by continuously applying a voltage of the same sign to TFT gate terminals, thereby extending device life.

<2.3 Effect>

As described above, in the present embodiment, the six grouped switch elements $SW_{(3j-2)a}$, $SW_{(3j-1)a}$, $SW_{3ja}$, $SW_{(3j-2)b}$, $SW_{(3j-1)b}$, and $SW_{3jb}$ are paired such that two switch elements $SW_{ia}$ and $SW_{ib}$ in each pair are alternatingly turned on to operate as one switch element. As a result, the number of times at which one switch element is turned on and a period in which the element is on are half of those of one conventional switch element, and therefore device life can be extended. Note that when amorphous silicon (a-Si), microcrystalline silicon (μc-Si), or an oxide semiconductor such as zinc oxide (ZnO) is used for semiconductor layers of TFTs functioning as the switch elements, a particularly significant effect can be achieved because the aforementioned threshold voltage shift tends to occur comparatively readily.

<3. Third Embodiment>

<3.1 Configuration and Operation of the Liquid Crystal Display Device>

A liquid crystal display device 100 according to a third embodiment of the present invention is configured in the same manner as in the second embodiment, except for the operation of switch elements $SW_i$ of a liquid crystal panel, and the same elements are denoted by the same characters with any detailed descriptions thereof omitted. Note that TFTs functioning as the switch elements $SW_i$ are also configured in the same manner as in the second embodiment.

However, in the present embodiment, the operation is performed so as to allow further extension of a short device life of the switch elements $SW_i$ compared to the second embodiment. Hereinafter, the operation of the switch elements $SW_i$ will be described with reference to FIG. 7, along with a method for driving the liquid crystal panel.

<3.2 Drive Method>

Figure 7:
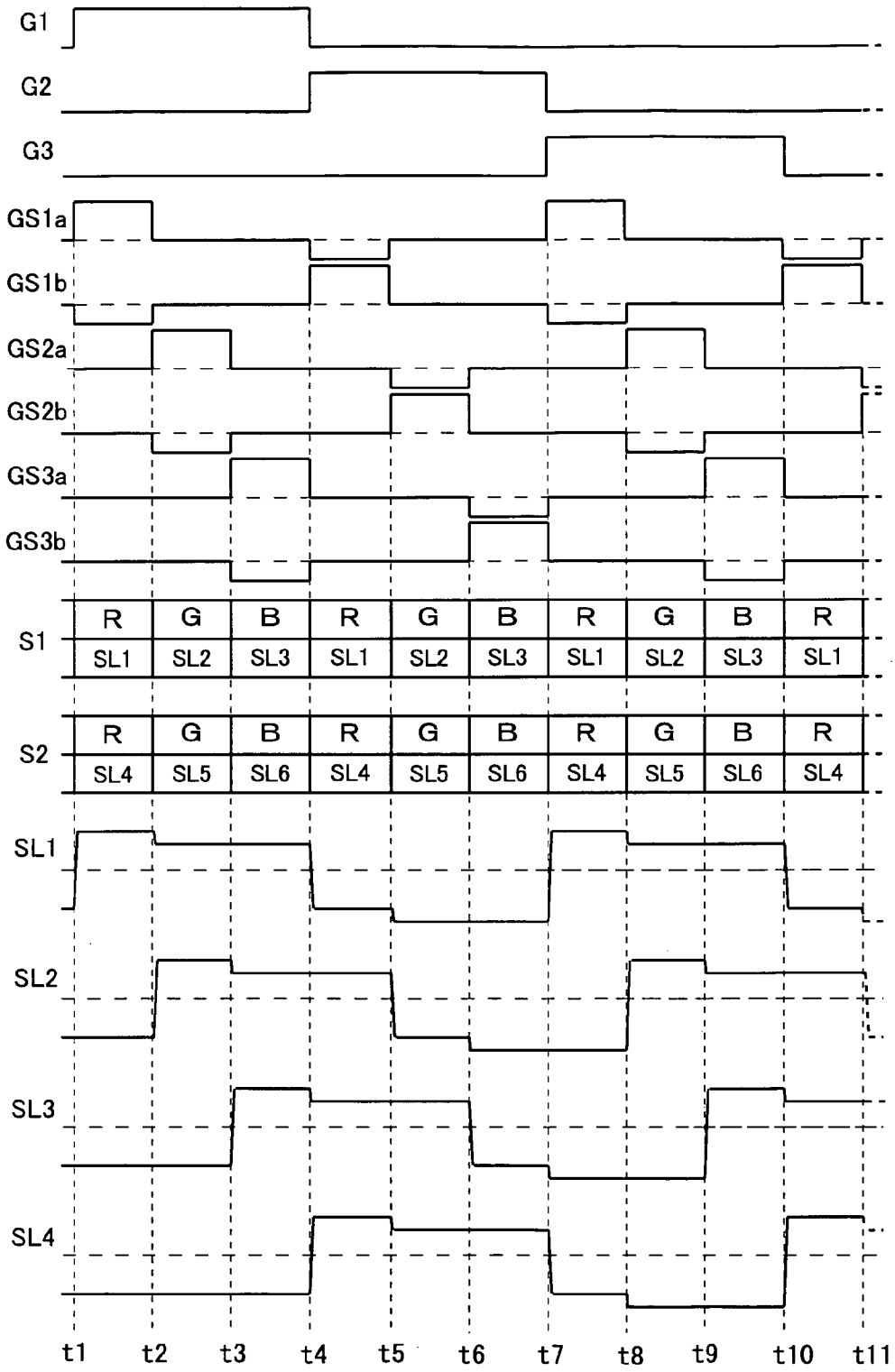
FIG. 7 is a timing chart describing a drive method for a liquid crystal display device according to a third embodiment of the present invention.
Figure 8:
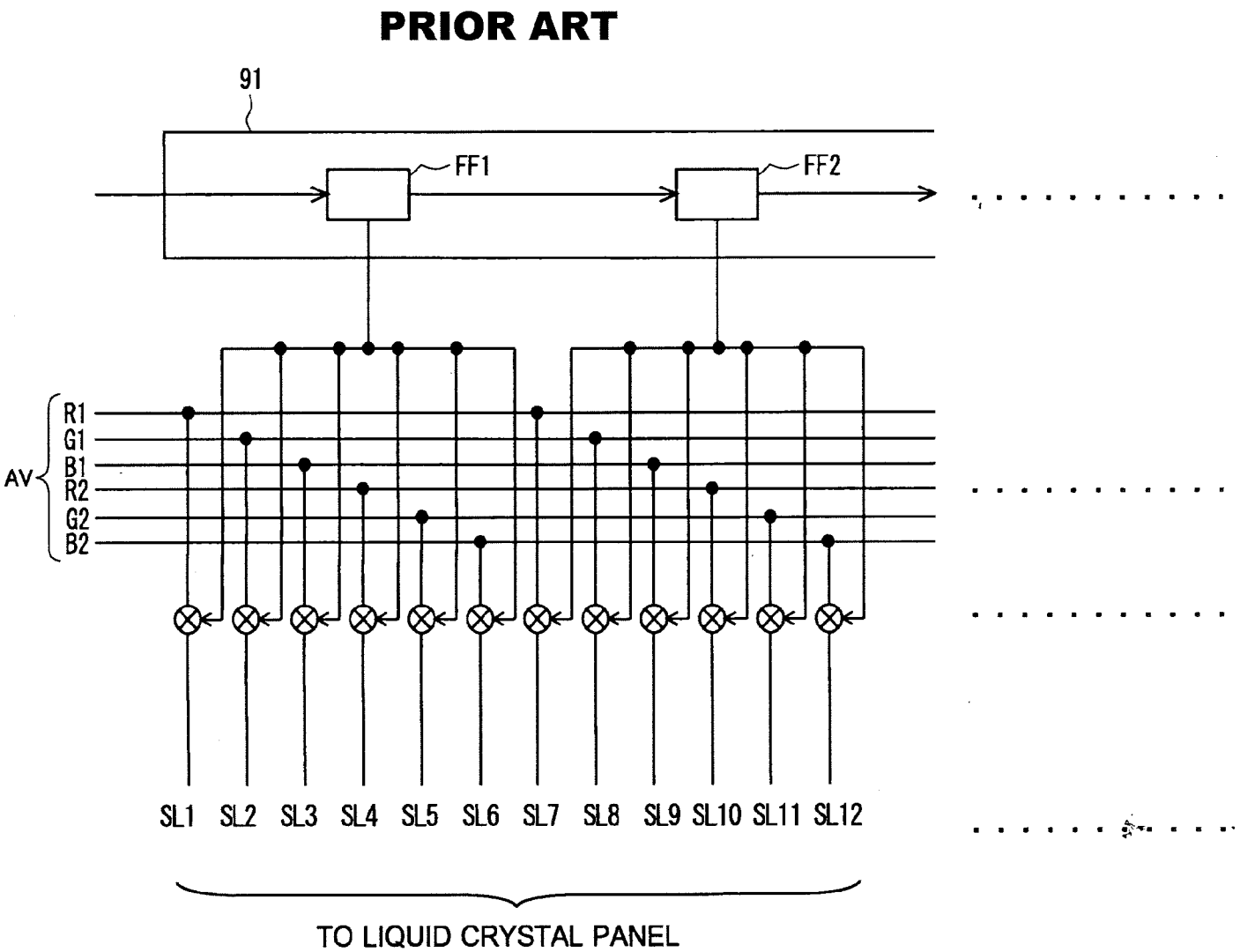
FIG. 8 is a partial configuration diagram of a data driver in a conventional liquid crystal display device in which two-phase expansion is performed.

FIG. 7 is a timing chart describing a drive method for the instant liquid crystal display device. For various signals, other than changeover control signals $GS_{1a}$ to $GS_{3b}$ indicating the operation timing for switch elements $SW_{(3j-2)a}$, $SW_{(3j-1)a}$, and $SW_{3ja}$, as shown in FIG. 7, they are different in period from those shown in FIG. 5 but approximately the same in waveform, and therefore any detailed descriptions thereof will be omitted.

Periods in which the changeover control signal $GS_{1a}$ shown in FIG. 7 is set at H level are the same as in the second embodiment shown in FIG. 6, but the signal is not set at L level during all the remaining periods, and it is set at a negative potential typically lower than L level (the potential being suitably set so as not to affect elements) during some of the remaining periods in which the changeover control signal $GS_{1b}$ corresponding to the other switch element in the pair is set at H level. Similarly, periods in which the changeover control signal $GS_{1b}$ is set at H level are also the same as in the second embodiment shown in FIG. 6, and the signal is set at a negative potential during some of the remaining periods in which the changeover control signal $GS_{1a}$ corresponding to the other switch element in the pair is set at H level. Note that the same applies to the changeover control signals $GS_{2a}$, $GS_{2b}$, $GS_{3a}$, and $GS_{3b}$ shown in FIG. 7. Here, the negative potential does not always have to be lower than L level so long as the gate potential of the switch element is negative with respect to the drain-source potential (which is a potential on the video signal line). Note that the same holds for an opposite combination of positive and negative signs.

In this manner, two paired switch elements $SW_{ia}$ and $SW_{ib}$ connected in parallel are alternatingly turned on to play the same role as one conventional switch element, as in the second embodiment, allowing extension of device life. In addition, while one switch element in the pair is on, a negative-potential changeover control signal is provided to the gate terminal of the other switch element, making it possible to suppress threshold voltage shift (beyond a normal range) caused by continuously applying a voltage of the same sign to TFT gate terminals, thereby extending device life.

Here, when a negative potential is provided to the gate terminal of a switch element, leakage current flows to a video signal line connected to the drain terminal, but in this case, as described above, the other switch element paired with that switch element is on, and therefore a video signal is continuously provided to the video signal line. Thus, the above drive mode can achieve a significant effect which renders leakage current less problematic (negligible).

<3.3 Effect>

As described above, in the present embodiment, the six grouped switch elements $SW_{(3j-2)a}$, $SW_{(3j-1)a}$, $SW_{3ja}$, $SW_{(3j-2)b}$, $SW_{(3j-1)b}$, and $SW_{3jb}$ are paired such that two switch elements $SW_{ia}$ and $SW_{ib}$ in each pair are alternatingly turned on to operate as one switch element, as in the second embodiment. As a result, the number of times at which one switch element is turned on and a period in which the element is on are half of those of one conventional switch element, and therefore device life can be extended. In addition, while one of two paired switch elements $SW_{ia}$ and $SW_{ib}$ is on, a negative potential is provided to the gate terminal of the other, making it possible to suppress threshold voltage shift (beyond a normal range) caused by continuously applying a voltage of the same sign. Thus, this also contributes to extension of device life. Note that when amorphous silicon (a-Si), microcrystalline silicon (μc-Si), or an oxide semiconductor such as zinc oxide (ZnO) is used for semiconductor layers of TFTs functioning as the switch elements, a particularly significant effect can be achieved because the aforementioned threshold voltage shift tends to occur comparatively readily.

<4. Variant>

In the configuration of the third embodiment, which is additionally applied to the second embodiment, while one of a pair of switch elements is on, a negative-potential changeover control signal is provided to the gate terminal of the other switch element, and this configuration is also applicable to the first embodiment. For example, by setting the potential of the changeover control signal $GS_{1a}$ to be negative from time $t_2$ to time $t_3$ in FIG. 5, the device life of the switch element $SW_{1a}$ can be extended.

Also, for example, unillustrated time $t_{1a}$ is set between time $t_1$ and time $t_2$ (preferably, close to time $t_2$), and the potential of the changeover control signal $GS_{1b}$ is set to be negative from time $t_{1a}$ to time $t_2$, thereby extending the device life of the switch element $SW_{1b}$ without causing the impact of leakage current of the switch element $SW_{1b}$ to become problematic. Here, in such a variant, by setting time $t_{1a}$ to be close to time $t_1$, the device life of the switch element $SW_{1b}$ can be extended but in the first embodiment, the switch element has low driving performance and therefore it is preferable that the switch element $SW_{1b}$ be turned off (a negative potential be provided) at a time point as far away as possible from a time point (here, time $t_1$) at which charging the video signal line starts.

In addition, when leakage current does not have much impact, a negative potential may be provided to the switch elements $SW_i$ during all or part of the periods in which an L-level switching signal is provided in the first or second embodiment. By doing so, the device life of the switch elements can be extended. Note that when it is desirable to reduce the impact of leakage current as much as possible, the negative potential is preferably not to be simultaneously provided to the other switch elements in pairs. As a result, no leakage current from the paired switch elements connected in parallel is superimposed.

While the foregoing embodiments have been described with respect to the case where two switch elements are connected in parallel to one video signal line, the number of switch elements connected in parallel may be three or more. For example, in the case of the first embodiment, for each horizontal scanning period, a plurality of grouped switch elements may be controlled to be turned on at approximately the same time, with a part thereof being the last to be turned off.

Also, in the case of the second embodiment, a plurality of grouped switch elements may be controlled such that a part of the group is turned on for each horizontal scanning period, and the sum total of on periods for each full horizontal scanning period or more is approximately equalized among the group. For example, when two of three grouped switch elements $SW_A$, $SW_B$ and $SW_C$ provide sufficient driving performance together, it is possible to perform drive such that the switch elements $SW_A$ and $SW_B$ are on during one horizontal scanning period with the switch element $SW_C$ off, the switch elements $SW_B$ and $SW_C$ are on during the next horizontal scanning period with the switch element $SW_A$ off, and the switch elements $SW_A$ and $SW_C$ are on during the following horizontal scanning period with the switch element $SW_B$ off, or it is possible to equalize the sum total of on periods for each three horizontal scanning periods among the switch elements and reduce the sum total of on periods to ⅔ of conventional. Also, for example, by performing drive such that one switch element is turned on during two horizontal scanning periods with the remaining two switch elements being inversely switched between on and off for each horizontal scanning period, and the drive mode (for on and off) of each switch element is changed for each two second horizontal scanning periods, it is possible to equalize the sum total of on periods for each six horizontal scanning periods among the switch elements and reduce the sum total of on periods to ⅔ of conventional. Furthermore, for example, when switch elements are driven while changing switch elements that are to be on within one horizontal scanning period, such that a portion of one horizontal scanning period in which to turn on some switch elements in certain groups is divided into three equal portions, the switch elements $SW_A$ and $SW_8$ are initially on during the first third of the period with the switch element $SW_C$ off, the switch elements $SW_B$ and $SW_C$ are on during the next third of the period with the switch element $SW_A$ off, and the switch elements $SW_A$ and $SW_C$ are on during the last third of the period with the switch element $SW_B$ off, it is possible to equalize the sum total of on periods for each horizontal scanning period among the switch elements and reduce the sum total of on periods to ⅔ of conventional. Note that in practice, the sum total of on periods does not always have to be completely equal among the switch elements, but if the sum total of on-periods for one switch element is larger than those of other switch elements, the device life of the entire device is shortened, and therefore it is preferable that the sum total of on periods be approximately equal among the switch elements.

Also, in the case of the third embodiment, a plurality of grouped switch elements may be controlled such that a predetermined potential of an opposite sign is provided to one switch element during part or all of the period in which the switch element is off and one or more of the remaining switch elements in the same group is/are on.

In the foregoing embodiments, the time-division driving system is employed with each horizontal scanning period being divided into three, but the number of divisions is not restrictive and each period may be divided into two or even four or more (e.g., 80). Note that the phase expansion driving system exemplified earlier in the conventional art and the video signal line time-division driving system in the embodiments can be considered to be the same in that, video signal lines are driven by sequentially applying video signals to a plurality of video signal line groups obtained by dividing a plurality of video signal lines into groups of two or more, on a group-by-group basis in predetermined order. For example, where the number of video signal lines for the liquid crystal display device 100 in each embodiment is 320×3 (RGB), in order to drive the lines with four-phase expansion processing for each piece of RGB image data, a writing operation is required to be performed a total of 80 times per horizontal scanning period. Accordingly, such drive can be viewed the same as drive by the video signal line time-division driving system with the number of time divisions being 80. Therefore, the present invention is applicable to display devices employing the phase expansion driving system. To configure a display device employing the phase expansion driving system as in, for example, the first embodiment, one of the two paired switch elements connected in parallel is provided with a pulse at the same time as conventional, while the other switch element is provided with a pulse which falls at a point slightly earlier than that pulse. As a result, it is possible to suppress the impact of fieldthrough phenomenon by reducing the parasitic capacitance Cgd of the aforementioned one switch element while it is possible to solve the impact of fieldthrough phenomenon due to the parasitic capacitance Cgd of the other switch element.

Furthermore, the present invention is also applicable to display devices employing the dot-sequence driving system. Specifically, the dot-sequence driving system differs from the phase expansion driving system, as well as the video signal line time-division driving system in the embodiments, in that video signal lines are not divided into groups of two or more, but it can be considered to be similar in that, if each video signal line is considered as the aforementioned group, the video signal lines are driven by applying video signals in predetermined order. To configure a display device employing the dot-sequence driving system as in, for example, the first embodiment, one of the two paired switch elements connected in parallel in the same group (these switch elements, together with a capacitor element, forming a sample and hold circuit) is provided with a sampling pulse at the same time as in conventional, while the other switch element (forming a part of the same sample and hold circuit) is provided with a sampling pulse which falls at a point slightly earlier than that sampling pulse. As a result, it is possible to suppress the impact of fieldthrough phenomenon by reducing the parasitic capacitance Cgd of the aforementioned one switch element while it is possible to solve the impact of fieldthrough phenomenon due to the parasitic capacitance Cgd of the other switch element.

While the embodiments have been described by taking as an example the active-matrix liquid crystal display device, the present invention can also be applied to active-matrix display devices using electro-optic elements other than liquid crystal elements, so long as the video signal line time-division driving system or the phase expansion system is employed. Note that in addition to the liquid crystal elements, the electro-optic elements here refer to any elements whose optical characteristics change when electricity is provided, such as LEDs (Light Emitting Diodes), including organic and inorganic EL elements, FED, charge-driven elements, and E-ink (Electronic Ink).

Industrial Applicability

The present invention is applicable to display devices with liquid crystal elements, EL elements, or the like, arranged in a matrix, and is suitable for display devices employing the dot-sequence driving system, the phase expansion driving system, the video signal line time-division driving system, etc.

Description Of The Reference Characters

10 TFT (thin-film transistor)
25 changeover control circuit
100 liquid crystal display device
200 display control circuit
300 video signal line drive circuit
400 scanning signal line drive circuit
500 liquid crystal panel
501 connection changeover circuit
SCK source clock signal
SSP source start pulse signal
GCK gate clock signal
GSP gate start pulse signal
Da digital image signal
$GS_{1a}$ to $GS_{3b}$ changeover control signal
$TS_1$, $TS_2$ output terminal
$G_k$ scanning signal (k=1, 2, 3, . . . )
$S_j$ video signal (j=1, 2, 3, . . . )
SL video signal line
Ls video signal line (column electrode)
Lg scanning signal line (row electrode)
Px pixel formation portion (pixel)
$SW_{ia}$, $SW_{ib}$ switch element (i=1, 2, 3, . . . )

The invention claimed is:

1. An active-matrix display device with a plurality of pixel formation portions for forming an image to be displayed, a plurality of video signal lines for transmitting signals representing the image to be displayed, and a plurality of scanning signal lines crossing the video signal lines, the plurality of pixel formation portions being arranged in a matrix so as to correspond to their respective intersections of the video signal lines and the scanning signal lines, the device comprising:

a scanning signal line drive circuit configured to selectively drive the scanning signal lines;

a video signal line drive circuit configured to drive the video signal lines by applying image signals inputted as the signals representing the image to be displayed, in predetermined order via a plurality of groups of switch elements, each group being provided so as to correspond to one of the video signal lines and consisting of a plurality of switch elements connected in parallel; and a display control circuit configured to control the switch elements such that, at least one of the switch elements in the same group is on during a period required for providing a corresponding image signal to a corresponding video signal line, a time point at which a part of the switch elements in the same group is turned off varies from a time point at which the remaining switch elements are turned off, and for each horizontal scanning period, the switch elements in the same group are turned on at approximately the same time, with a part of the group being the last to be turned off.

2. The display device according to claim 1, wherein the video signal line drive circuit includes:

a video signal output circuit configured to output video signals from a plurality of output terminals in a time-division manner within a predetermined period, the output terminals respectively corresponding to a plurality of video signal line groups into which the video signal lines are divided, the video signals being transmitted by the video signal line groups corresponding to the output terminals; and a connection changeover circuit including the switch elements configured to connect the output terminals of the video signal output circuit to any video signal lines in the video signal line groups each corresponding to one of the output terminals, thereby providing the video signals to any pixel formation portions coupled to the connected video signal lines and the scanning signal lines selected by the scanning signal line drive circuit, the switch elements being operable such that, for each of the video signal line groups, the video signal lines to be connected to the output terminals corresponding to that the video signal line group are switched in accordance with the time-division.

3. The display device according to claim 2, wherein the video signal output circuit has a plurality of output terminals corresponding to their respective video signal line groups into which the video signal lines are divided, each group consisting of three adjacent video signal lines respectively coupled to three varieties of pixel formation portions for displaying three predetermined primary colors.

4. The display device according to claim 1, wherein the switch elements are thin-film transistors each having a semiconductor layer made of microcrystalline silicon, amorphous silicon or an oxide semiconductor.

5. The display device according to claim 1, wherein the switch elements are thin-film transistors each having a semiconductor layer and the last part to be turned off among the switch elements in the same group is smaller than the remaining switch elements.

6. The display device according to claim 1, wherein the display control circuit controls the switch elements such that a part of the switch elements in the same group is turned on for each horizontal scanning period, and the sum total of on periods for each full horizontal scanning period or more is approximately equalized among the switch elements in the same group.

7. The display device according to claim 1, wherein, during all or part of an off period, the display control circuit provides the switch elements in the same group with a predetermined potential of a sign opposite to an on potential provided during an on period.

8. The display device according to claim 7, wherein the display control circuit provides at least one of the switch elements in the same group with the predetermined potential of the opposite sign during all or part of the off period for the at least one switch element while one or more of the remaining switch elements in the same group, excluding the at least one switch element, are on.

9. A liquid crystal display device wherein pixel formation portions of claim 1 include liquid crystal elements.

10. A method for driving an active-matrix display device with a plurality of pixel formation portions for forming an image to be displayed, a plurality of video signal lines for transmitting signals representing the image to be displayed, and a plurality of scanning signal lines crossing the video signal lines, the plurality of pixel formation portions being arranged in a matrix so as to correspond to their respective intersections of the video signal lines and the scanning signal lines, the method comprising:

selectively driving the scanning signal lines;

driving the video signal lines by applying image signals inputted as the signals representing the image to be displayed, in predetermined order via a plurality of groups of switch elements, each group being provided so as to correspond to one of the video signal lines and consisting of a plurality of switch elements connected in parallel; and controlling the switch elements such that, at least one of the switch elements in the same group is on during a period required for providing a corresponding image signal to a corresponding video signal line, a time point at which a part of the switch elements in the same group is turned off varies from a time point at which the remaining switch elements are turned off, and for each horizontal scanning period, the switch elements in the same group are turned on at approximately the same time, with a part of the group being the last to be turned off.

11. An active-matrix display device with a plurality of pixel formation portions for forming an image to be displayed, a plurality of video signal lines for transmitting signals representing the image to be displayed, and a plurality of scanning signal lines crossing the video signal lines, the plurality of pixel formation portions being arranged in a matrix so as to correspond to their respective intersections of the video signal lines and the scanning signal lines, the device comprising:

a scanning signal line drive circuit configured to selectively drive the scanning signal lines;

a video signal line drive circuit configured to drive the video signal lines by applying image signals inputted as the signals representing the image to be displayed, in predetermined order via a plurality of groups of switch elements, each group being provided so as to correspond to one of the video signal lines and consisting of a plurality of switch elements connected in parallel; and a display control circuit configured to control the switch elements such that, at least one of the switch elements in the same group is on during a period required for providing a corresponding image signal to a corresponding video signal line, and a time point at which a part of the switch elements in the same group is turned off varies from a time point at which the remaining switch elements are turned off, wherein during all or part of an off period, the display control circuit provides the switch elements in the same group with a predetermined potential of a sign opposite to an on potential provided during an on period.

12. The display device according to claim 11, wherein the video signal line drive circuit includes:

a video signal output circuit configured to output video signals from a plurality of output terminals in a time-division manner within a predetermined period, the output terminals respectively corresponding to a plurality of video signal line groups into which the video signal lines are divided, the video signals being transmitted by the video signal line groups corresponding to the output terminals; and a connection changeover circuit including the switch elements configured to connect the output terminals of the video signal output circuit to any video signal lines in the video signal line groups each corresponding to one of the output terminals, thereby providing the video signals to any pixel formation portions coupled to the connected video signal lines and the scanning signal lines selected by the scanning signal line drive circuit, the switch elements being operable such that, for each of the video signal line groups, the video signal lines to be connected to the output terminals corresponding to that the video signal line group are switched in accordance with the time-division.

13. The display device according to claim 12, wherein the video signal output circuit has a plurality of output terminals corresponding to their respective video signal line groups into which the video signal lines are divided, each group consisting of three adjacent video signal lines respectively coupled to three varieties of pixel formation portions for displaying three predetermined primary colors.

14. The display device according to claim 11, wherein the switch elements are thin-film transistors each having a semiconductor layer made of microcrystalline silicon, amorphous silicon or an oxide semiconductor.

15. The display device according to claim 11, wherein the display control circuit is further configured to control the switch elements such that, or each horizontal scanning period, the switch elements in the same group are turned on at approximately the same time, with a part of the grouped being the last to be turned off, the switch elements being thin-film transistors each having a semiconductor layer and the last part to be turned off among the switch elements in the same group is smaller than the remaining switch elements.

16. The display device according to claim 11, wherein the display control circuit controls the switch elements such that a part of the switch elements in the same group is turned on for each horizontal scanning period, and the sum total of on periods for each full horizontal scanning period or more is approximately equalized among the switch elements in the same group.

17. The display device according to claim 11, wherein the display control circuit provides at least one of the switch elements in the same group with the predetermined potential of the opposite sign during all or part of the off period for the at least one switch element while one or more of the remaining switch elements in the same group, excluding the at least one switch element, are on.

18. A liquid crystal display device wherein pixel formation portions of claim 11 include liquid crystal elements.

* * * * *